US005746083A

United States Patent [19]

Kovarovic et al.

[11] Patent Number: 5,746,083

[45] Date of Patent: May 5, 1998

[54] HEMMING MACHINE

[75] Inventors: Josef Kovarovic, Leicestershire, United Kingdom; John Ralph Kowalewsky, West Midlands, Great Britain

[73] Assignee: Western Atlas U.K. Limited, Buckinghamshire, United Kingdom

[21] Appl. No.: 693,320

[22] PCT Filed: Feb. 13, 1995

[86] PCT No.: PCT/GB95/00288

§ 371 Date: Oct. 7, 1996

§ 102(e) Date: Oct. 7, 1996

[87] PCT Pub. No.: WO95/21710

PCT Pub. Date: Aug. 17, 1995

[30] Foreign Application Priority Data

Feb. 14, 1994 [GB] United Kingdom ..... 9402760

[51] Int. Cl.[6] ..... B21D 39/02

[52] U.S. Cl. ..... 72/315; 72/312; 29/243.58

[58] Field of Search ..... 72/312–315, 306, 72/316; 29/243.58, 243.5

[56] References Cited

U.S. PATENT DOCUMENTS

| | | | |
|---|---|---|---|
| 3,147,726 | 9/1964 | Tribe | 29/243.58 |
| 3,191,414 | 6/1965 | Kollar | 72/48 |
| 3,566,817 | 3/1971 | DeCastelet | 113/116 |
| 3,598,073 | 8/1971 | St. Denis | 29/243.5 |
| 5,086,638 | 2/1992 | David | 72/451 |
| 5,259,230 | 11/1993 | Beyers | 72/319 |

FOREIGN PATENT DOCUMENTS

| | | | |
|---|---|---|---|
| 2 645 053 | 10/1990 | France . | |
| 110427 | 6/1984 | Japan | 72/313 |

*Primary Examiner*—Daniel C. Crane

*Attorney, Agent, or Firm*—Lee, Mann, Smith, McWilliams, Sweeney & Ohlson

[57] ABSTRACT

A hemming machine adapted to externally and internally hem a sheet metal fabrication comprising an anvil which itself is apertured so as to register with an aperture in the metal fabrication which is to be internally hemmed, wherein additional hemming apparatus is provided mounted at the upper end of a drive, and support means is located below and protruding up through the opening in the anvil so as to protrude the opening in the fabrication, further comprising a hemming tool displaceable vertically and horizontally having a chamfered lower leading edge, a slidable block carrying the tool at one end, drive means for positioning the slide vertically, and further drive means for positioning the block within the slide for positioning the tool horizontally, a second anvil resiliently displaceable and engaging the underside of the tool or normally raise the latter relative to its lowermost position, and wherein the upper surface of the block is adapted to withstand an impact force and transmit same to the tool to force the tool in a downward direction until the tool and block bottom on stop means. A method of internal and external hemming is also disclosed.

15 Claims, 3 Drawing Sheets

HEMMING MACHINE

This application is a 371 of PCT/GB95/00288, filed Feb. 13, 1995.

FIELD OF INVENTION

This invention relates to hemming machines for hemming the peripheral edge of sheet metal fabrication such as vehicle door panels.

BACKGROUND OF THE INVENTION

Metal hemming machines for hemming the external periphery of sheet metal fabrications such as vehicle doors are supplied inter alia by Western Atlas Inc of Warren, Mich. 48091, USA. Such machines provide an anvil on which the metal fabrication can rest and a pair of tools or steels which first of all bend over an upturned lip along the periphery which is to be hemmed and then flatten the bent over lip against the fabrication either so as to simply reinforce the edge or trap therein an edge of a second part of the fabrication.

It is an object of the present invention to adapt such a machine to allow an internal opening within a sheet metal fabrication likewise to be hemmed at the same time as the fabrication is externally hemmed without removing the fabrication from the machine and preferably without moving the fabrication within the machine.

SUMMARY OF THE INVENTION

According to the present invention in a hemming machine adapted to hem a sheet metal fabrication around an external peripheral edge thereof and comprising an anvil on which the fabrication rests which itself is apertured so as to register at least with an aperture in the metal fabrication which is also to be internally hemmed, additional hemming apparatus mounted at the upper end of drive and support means located below and protruding up through the opening in the anvil so as to protrude through the opening in the fabrication, comprising:

1. a hemming tool which is displaceable upwardly and downwardly as well as horizontally and which includes a chamfered lower leading edge, 2. a block carrying the tool at one end and movable in a slide, the drive means acting to position the slide vertically, 3. drive means for positioning the block within the slide to position the tool horizontally, 4. a second anvil resiliently displaceable and engaging the underside of the tool normally to raise the latter relative to its lowermost position to enable the tool to move horizontally and effect preliminary internal hemming, and 5. the upper surface of the block is adapted thereafter to withstand an impact force and transmit same to the tool to force the tool in a downward direction until the tool and block bottom on stop means.

Preferably the horizontal movement of the block and tool is achieved by a vertical movement of a nut on a lead screw itself driven by a servo motor and the vertical movement is translated to horizontal movement by means of cam means acting on the block.

In one embodiment, the lead screw nut includes an upstanding arm which over part of its length is bent over at an angle to the vertical so that movement of the arm in a vertical sense causes a member engaging the inclined part of the arm to be moved backwards and forwards.

Alternatively the block may be driven back and forward by hydraulic means or other drive means such as a servo motor located in line with the block and slide.

According to a particularly preferred feature of the invention, the impact force may be applied to the block by means of a hammer member attached to the drive mechanism associated with the external hemming tooling and synchronisation is provided between the internal and external hemming tooling operations so that the hammer attached to the external tooling is ready to descend onto the block of the internal tooling at the same instant as the internal tooling has achieved its required lateral displacement so that the flat underside of the inner tool is overlying the flattened tab of the internal hem so that the final squeeze of both internal and external hem is achieved by the same tool acting directly on the external hem and indirectly through the block and hemming tool of the internal hemming arrangement.

Where the whole of the external periphery of the fabrication is to be externally hemmed, hemming tooling will be provided around the whole of the external periphery and if the corresponding peripheral regions of the opening are likewise to be internally hemmed, similar internal tooling may be provided along the internal edges.

The hammer means for engaging the block supporting the inner hemming tool may comprise an overhanging abutment extending from and joined to or integral with the outer hemming steel and adapted to bridge the metal fabrication laid on the anvil.

The same servo motor may be used to drive the internal and external hemming tooling.

According to another aspect of the invention a method of internally and externally hemming a metal fabrication laid on an anvil and presenting internal and external edges for hemming, comprises the steps of:

1. outwardly moving an internal hemming tool having an inclined lower leading edge towards an upstanding internal peripheral abutment lip, forcing the lip to bend over and lie generally flat, 2. permitting the tool to rise up by a limited amount as it engages the lip so that the force exerted by the forwardly moving tool face is exerted in the optimum manner to bend the lip instead of crushing it, 3. moving the tool forward over the bent over lip until a flat underside of the tool rests on the downturned lip and 4. applying an impact force so as to transmit a downward force onto the bent over lip and squeeze the latter between it and the sheet metal from which it has been formed against the anvil, wherein 5. the impact force is transmitted through a common member simultaneously to the internal and external hems.

According to a preferred feature of this method, the external hemming impact to achieve the final hemming is applied simultaneously as the internal final hemming impact.

Preferably a resiliently displaceable upwardly directed anvil is applied to the underside of the internal hemming tool so as to cause the latter to adopt an upper raised position until it is impacted from above to perform the final hemming step on the internal hem.

The invention will now be described by way of example with reference to the accompanying drawings, in which.

Figure 1:
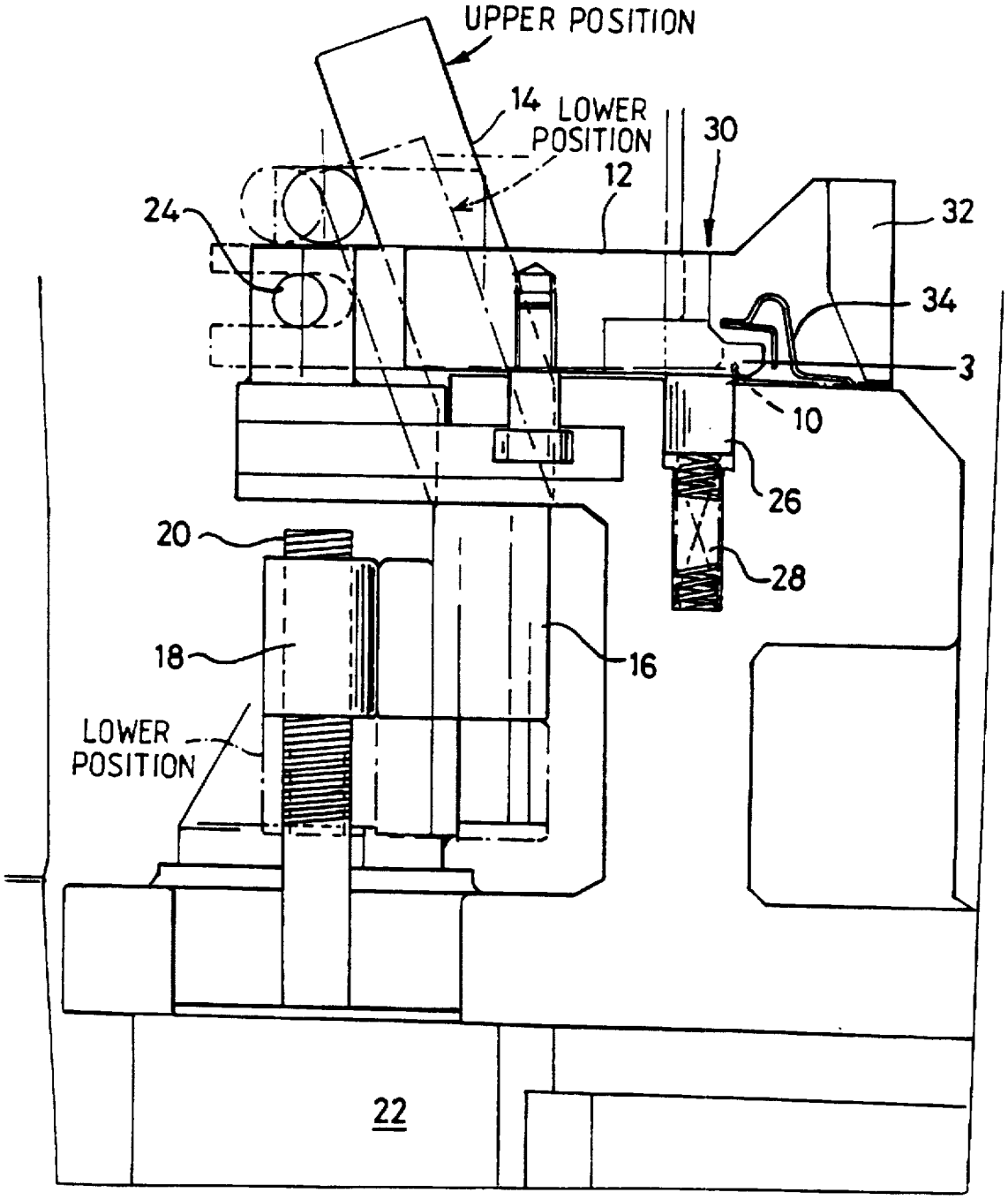
FIG. 1 is a diagrammatic side view of an inner and outer hemming apparatus constructed in accordance with the invention.

In FIG. 1 tool 3 is driven forward over the upstanding tab shown in dotted outline at 10 so as to flatten the latter into the position shown in FIG. 1 under the operation of a block 12 to which the tool is attached. The latter is pushed forwardly by the upward movement of a cam slide 14 which extends from the top end of a bracket 16 itself attached to a screw 18 on a lead screw 20. The latter is driven by a servo motor 22.

The block 12 is bifurcated at its rear end and includes slots through which a pin 24 extends about which the block can pivot but by virtue of the slot can also slide relative to the pin.

Below the tool 3 is located a movable anvil 26 biased upwardly by a spring 28 to force the tool into an upward position in which it is slightly inclined relative to the horizontal so as to better push over the tab 10 during initial impact. Final hemming is achieved by lowering onto the upper end of the block 12 an inboard downwardly protruding section 30 of a hemming steel 32 adapted to perform the final hemming step on an outer edge of the fabrication generally designated 34 located on the machine anvil 36.

Typically the normal outer hemming steel 32 is simply extended to provide the pressure point 30 for pushing the block and tool downwards to flatten the downturned tab 10 and form the internal hem.

The block can be driven back and forward by hydraulic means or by a linear motor which may be included within the slide or may be mounted orthogonally and linked to the slide via a cam drive means to change the direction of motion.

Preferably as shown the servo motor 22 drives the lead screw 20 and a ball nut 18 so as to cause the latter to rise and fall and thereby raise and lower the 45° arm 14. A cam follower is provided on the block 12 in the slide.

An advantage of using a servo motor in either location is that it can be indexed accurately and the revolutions counted so as to stop the loading at the desired point so as to prevent the steel hem being unduly squashed.

Typically the same servo motor may be employed for the internal hemming tooling as for the outer hemming tooling.

Figure 2:
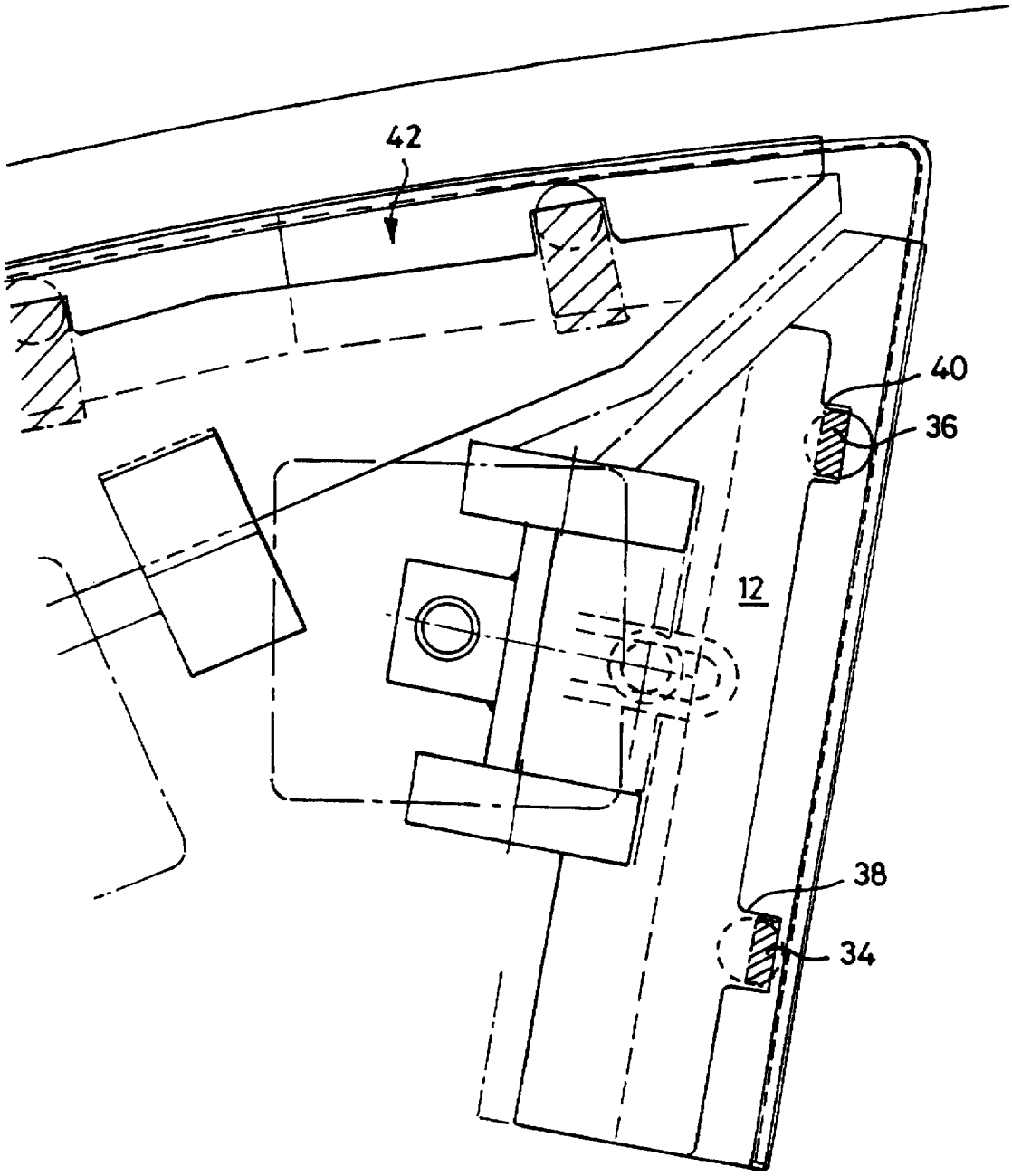
FIG. 2 is a diagrammatic plan view showing how an internal hemming mechanism can be fitted along two adjoining edges of the window opening in a vehicle door.

FIG. 2 shows how the outer hemming steel may be formed into two legs which are shown in cross-section at 34 and 36 so as to press upon protruding arms 38 and 40 from the block 12. This ensures that the latter transmit thrust from the impact force applied direct to the tool 3 (not shown in FIG. 2).

Chamfering the corner of the tooling, means that a second set of tooling can be located along the adjoining edge of the opening as shown generally at 42.

Figure 3:
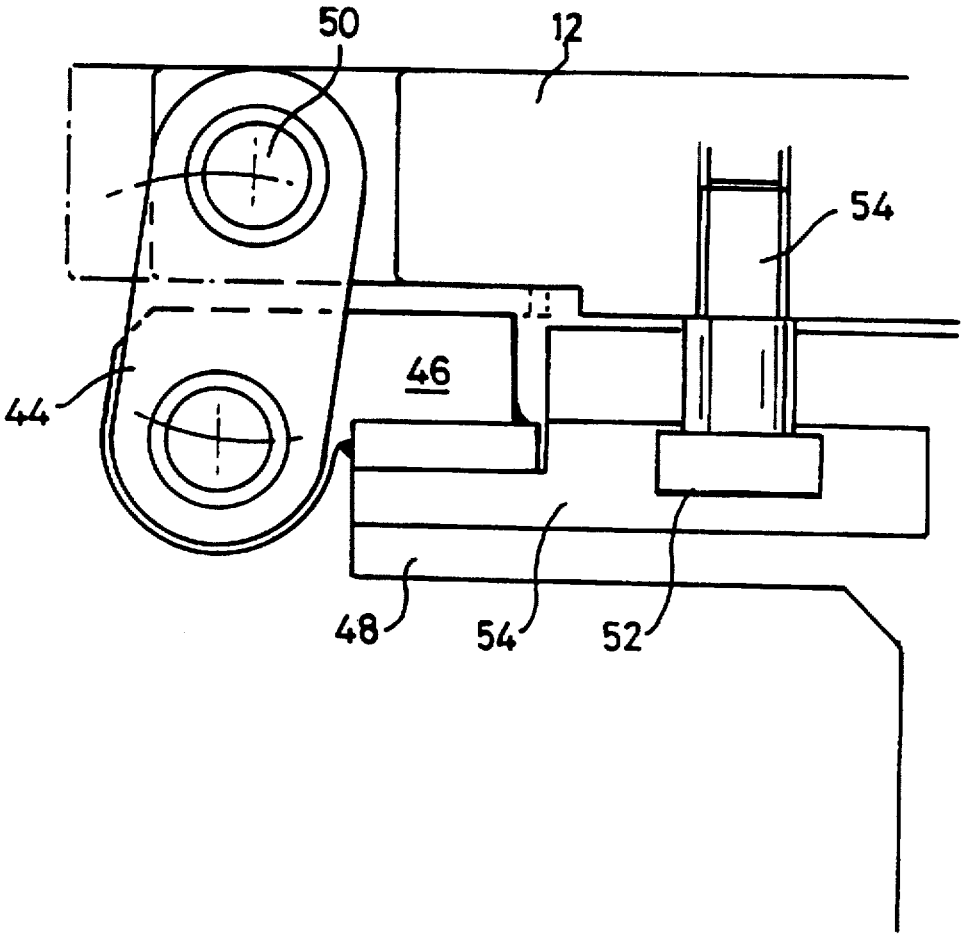
FIG. 3 illustrates an alternative arrangement for permitting both upward and downward and forward and backward movement of the block in the slide of FIG. 1.

FIG. 3 shows an alternative to the provision of the slot and pin of FIG. 1. Here a short link 44 is pivotally joined to a bracket 46 carried by a fixed machine part 48 and the upper end is pivotally joined to the rear of the block 12 at 50.

The block is held captive in both embodiments by means of the captive head 52 of a bolt 54 threadedly engaged in an appropriately threaded aperture in the underside of the block and protruding into a slideway generally designated 54. The head of the bolt 52 prevents the spring 28 raising the tool by more than a given amount which is sufficient nevertheless to enable the tool to ride up and attack the upstanding lip at the correct angle to assist the latter in being bent into its downward position as shown in FIG. 1.

We claim:

1. A hemming machine adapted to externally hem a sheet metal fabrication around an external peripheral edge thereof, comprising a first anvil on which the fabrication rests and having an opening so as to register at least with an aperture in the metal fabrication which is also to be internally hemmed; an external hemming tool moveable downwards against the first anvil; an internal hemming tool mounted at an upper end of drive means located below and protruding up through the opening in the first anvil so as to protrude through the aperture in the fabrication; the internal tool being displaceable upwardly and downwardly as well as horizontally, and including a chamfered lower leading edge; a block carrying the internal tool at one end and horizontally movable in a slide, the block being adapted to transmit a force to the internal tool to force the tool in a downward direction against the internal hem of the fabrication; cam means engageable by the drive means for positioning the internal tool horizontally; and a movable second anvil resiliently displaceable and engageable with the underside of the internal tool to raise the latter relative to its lowermost position to enable the internal tool to move horizontally and effect a preliminary internal hemming.

2. A hemming machine according to claim 1, wherein the horizontal movement of the block and internal tool is achieved by a vertical movement of a nut on a lead screw.

3. A hemming machine according to claim 2, wherein the lead screw is driven by a servo motor and the vertical movement is translated to horizontal movement by the cam means acting on the block.

4. A hemming machine according to claim 1, wherein the cam means comprises an upstanding arm which over part of its length is bent over at an angle to the vertical so that movement of the arm in a vertical sense causes a member engaging the inclined part of the arm to be moved horizontally backwards and forwards.

5. A hemming machine according to claim 2, wherein the block is driven back and forward by drive means located in line with the block and slide.

6. A hemming machine according to claim 5, wherein the block drive is hydraulic on a servo motor.

7. A hemming machine according to claim 1, wherein a hammer member is attached to the drive mechanism associated with the external hemming tool to impart impact force to the block and wherein the internal and external hemming tool operations are synchronous so that the hammer member attached to the external tool is ready to descend onto the block of the internal tool at the same instant as the internal tool has achieved its required lateral displacement, so that the flat underside of the internal tool is overlying the flattened tab of the internal hem, ready for a final squeeze.

8. A hemming machine according to claim 7, wherein the final squeeze of both internal and external hems is achieved by the external tool acting directly on the external hem and indirectly through the block and internal tool.

9. A hemming machine according to claim 1, wherein the external hemming tool is provided around the whole of the external periphery of the fabrication to be hemmed.

10. A hemming machine according to claim 9, in which the internal hemming tool is provided along the internal edge of the aperture in the fabrication, to permit the internal edges thereof to be hemmed.

11. A hemming machine according to claim 1, wherein hammer means for engaging the block supporting the internal tool comprises an overhanging abutment extending from and joined to or integral with the external tool and adapted to bridge the metal fabrication laid on the first anvil.

12. A hemming machine according to claim 1, wherein a single servo motor is used to drive the internal and external hemming tools.

13. A method of internally and externally hemming a sheet metal fabrication laid on a first anvil and presenting internal and external edges for hemming, comprising the steps of:

a) outwardly moving an internal hemming tool having an inclined lower leading edge in a forward direction towards an upstanding internal peripheral abutment lip and forcing the lip to bend over and lie generally flat, b) permitting the internal tool to rise up by a limited amount as it engages the lip so that the force exerted by the forwardly moving tool face is exerted in the optimum manner to bend the lip instead of crushing it, c) moving the internal tool forward over the bent-over lip until a flat underside of the tool rests on the downturned lip, d) applying an impact force so as to transmit a downward force onto the bent-over lip and squeeze the latter between the sheet metal fabrication from which it has been formed and the first anvil, and e) moving an external hemming tool towards an external hem;

f) wherein the impact force is transmitted through a common member of the internal and external hemming tools simultaneously to the internal and external hems.

14. A method of hemming according to claim 13, wherein the impact force on the external hem to achieve the final hemming is applied simultaneously with the final impact force on the internal hem.

15. A method of hemming according to claim 13, wherein a resiliently displaceable and upwardly directed second anvil is applied to the underside of the internal hemming tool so as to cause the latter to adopt an upper raised position until it is impacted from above to perform the final hemming step on the internal hem.

* * * * *